United States Patent [19]

Williams

[11] Patent Number: 4,821,047

[45] Date of Patent: Apr. 11, 1989

[54] MOUNT FOR SATELLITE TRACKING DEVICES

[75] Inventor: Thomas H. Williams, Doraville, Ga.

[73] Assignee: Scientific-Atlanta, Inc., Atlanta, Ga.

[21] Appl. No.: 820,655

[22] Filed: Jan. 21, 1986

[51] Int. Cl.[4] ..... H01Q 3/02

[52] U.S. Cl. ..... 343/882; 343/765; 343/766

[58] Field of Search ..... 343/882, 765, 766, 880, 343/881

[56] References Cited

U.S. PATENT DOCUMENTS

| | | | |
|---|---|---|---|
| 2,472,824 | 6/1949 | Hays | 343/882 |
| 3,510,877 | 5/1970 | Turriere | 343/760 |
| 3,714,660 | 1/1973 | Scrafford et al. | 343/757 |
| 3,852,763 | 12/1974 | Kreutel, Jr. et al. | 343/761 |
| 3,945,015 | 3/1976 | Gueguen | 343/765 |
| 4,126,865 | 11/1978 | Longhurst et al. | 343/766 |
| 4,232,320 | 11/1980 | Savalle, Jr. | 343/765 |
| 4,251,819 | 2/1981 | Vickland | 343/882 |
| 4,284,061 | 8/1981 | Wildenrotter | 343/765 |
| 4,454,515 | 6/1984 | Major et al. | 343/882 |
| 4,490,724 | 12/1984 | Bickman | 343/766 |
| 4,626,864 | 12/1986 | Micklethwaite | 343/882 |
| 4,652,890 | 3/1987 | Crean | 343/882 |

FOREIGN PATENT DOCUMENTS

| | | | |
|---|---|---|---|
| 2702340 | 7/1978 | Fed. Rep. of Germany | 343/765 |
| 0090403 | 5/1985 | Japan | 343/882 |
| 0187104 | 9/1985 | Japan | 343/880 |

OTHER PUBLICATIONS

Booklet entitled "Earth Station Geometry", by Fred Fonda, Staff Engineer, Scientific Atlanta, Inc.

*Primary Examiner*—William L. Sikes
*Assistant Examiner*—T. Le Hoanganh
*Attorney, Agent, or Firm*—Kilpatrick & Cody

[57] ABSTRACT

Mounts for satellite tracking antennas or other devices. Mounts according to the invention aim antennas or other devices at various satellites along the geosynchronous satellite arc by creating a mechanical analog of that arc and forcing the axis of the antenna or device to rotate through the analogous arc. This is accomplished by fixing an Earth center analog point and mechanically constraining the axis of the antenna or device to rotate about a site-analog point which is located vertically a predetermined distance from the Earth center analog point. A rotating arm through which the axis of the antenna or device may pass swings the axis through an arc which is in a plane parallel to the Earth's equatorial plane and which has the Earth center analog point at its center and a radius of 6.611 times the predetermined distance between the Earth center analog point and the site-analog point. The arm may be rotated to aim the antenna or device at various satellites along the geosynchronous satellite arc. Such mounts may also be used to aim devices at satellites in non-geosynchronous orbit in the plane of the Earth's equator. In such cases, the axis of the device intersects an arc having a radius corresponding to the radius of the satellite orbit relative to the Earth's radius, which may be more or less than 6.611. A constant speed actuator drives the carrying member to track the satellite.

13 Claims, 9 Drawing Sheets

MOUNT FOR SATELLITE TRACKING DEVICES

The present invention relates to mounts used for aiming antennas and other devices at bodies in orbits about the Earth's equator. Mounts according to this invention may be positioned easily and with a minimum of adjustment to aim such devices at various satellites and other bodies quickly and accurately.

BACKGROUND OF THE INVENTION

Satellites utilized for relaying broadcast signals and for other purposes are placed in geosynchronous orbit about the Earth so that they may be tracked with transmitting and receiving antennas that remain stationary. Such satellites must be located in an orbit about the Earth having a radius of 6.611 Earth radii to remain in a stationary position with respect to the Earth's surface. The plane of the orbit must be coplanar with the equatorial plane of the Earth to prevent apparent declination change. The period of orbital rotation of a satellite so situated is equal to the period of Earth rotation and its position as viewed from earth is constant.

Present recommended coverage guidelines suggest that such satellites should be located in an equatorial orbit between 70° west longitude and 135° west longitude for continential United States coverage. Various geosynchronous satellites utilized for United States broadcasting purposes are accordingly found on the arc described as the locus of points at 6.611 Earth radii from the center of the Earth, in the Earth's equatorial plane, and from approximately 70° west longitude through approximately 135° west longitude. Thus, Satcom F4, whose transponders relay various television network programming, is presently (in 1985) located at 83° west longitude on this arc, while Galaxy 1, utilized for certain "super channels" and other television programming, is presently (in 1985) located at 134° west longitude.

Those who transmit signals to or receive programs from such satellites or otherwise have reason to aim devices at such satellites frequently wish to reposition their antennas or devices toward various satellites to receive various programs or for other reasons. Existing antenna mounts allow such repositioning but require a compromise between accuracy and ease and speed of positioning.

In a first general group of existing mounts are antenna mounts which allow the antenna to be rotated about two axes. Two-axis mounts are advantageous because they may theoretically be pointed in any direction in the sky and accurately positioned by adjusting the rotation of the antenna about each axis. The two-axis systems are characterized by the orientation of the lower-most axis with respect to the ground. A two-axis system having its lower axis perpendicular to the ground is referred to as "elevation-over-azimuth" and one that has its lower axis parallel to the ground is referred to as an "x-y system." A system which has its lower axis parallel to the Earth's axis of rotation is referred to an "hour angle-declination" or "polar" mount because the left-right rotation of the antenna is about its hour angle axis (an axis parallel to the earth's polar axis) while the up and down rotation is about the antenna's declination axis.

An x-y mount is structurally less complicated than an elevation-over-azimuth mount because the ground and foundation provide direct support for the lower-most, horizontal elevational axis of the antenna. By contrast, the lower-most axis of the elevation-over-azimuth mount is perpendicular to the ground, requiring horizontally oriented structure to be located in the upper portion of the mount to support the elevational axis.

A typical x-y axis configuration places the x axis through the rear two feet of the mount and rotation about that axis may be adjusted with an adjustable front third foot. The rear two feet support a first, upper point of rotation for the y axis and the front foot supports the other point of rotation for the y axis. An adjustable structure between either of the two rear feet and the antenna allow the antenna to be adjusted about the y axis.

The hour angle axis in the polar mount is aligned parallel with the Earth's axis or inclined in a north-south direction from local horizontal at an angle equal to the site latitude. It is possible by rotating the antenna about the axis of such a system at one revolution per day to keep the antenna line of sight fixed at a point on the celestial sphere. Many astronomical telescopes have the polar axis configuration because of this characteristic. To point to a geosynchronous satellite in the equatorial plane, however, the antenna on such a mount must be depressed in declination because of the finite satellite orbital radius. The amount of declination required is a function of the satellite longitude, the site longitude and the site latitude.

Less complicated are single axis positioning systems. A single axis system which has the beam or elevational axis perpendicular to the axis of rotation may be considered to be an x-y mount whose lower axis is fixed after installation at a particular site. The system operates on the theory that rotation about an axis which is normal to the plane passing through the site and two geosynchronous satellites will aim the antenna at the two satellites with zero pointing error. The pointing errors for geosnychronous satellites between and beyond the two satellites are generally small. For example, if such a system is configured to point at Comstar 1° at 128° west longitude and Comstar 2 at 95° west longitude, all satellites from 87° through 135° are within approximately 0.4° of the antenna line of sight.

The single axis mount may be modified by "tilting" the antenna with respect to the rotational axis so that its line of sight forms a cone about the rotational axis. This configuration attempts to compensate for the offset of the antenna site with respect to the Earth's center.

SUMMARY OF THE INVENTION

The present invention aims an antenna or other device at various satellites along the geosynchronous satellite arc by creating a mechanical analog of that arc and forcing the axis of the antenna or device to rotate through the analogous arc. It does this by fixing an Earth center analog point and mechanically constraining the axis of the antenna or device to pivot about a site-analog point which is located at a predetermined distance from the Earth center analog point along a line oriented vertically, or in the direction of the radius of the Earth at the site. A rotating arm through which the axis of the antenna or device may pass swings the axis through an arc which is in a plane parallel to the Earth's equatorial plane, which has the Earth center analog point as its center, and which has a radius of 6.611 times the predetermined distance between the Earth center analog point and the site analog point. The arm may be rotated to aim the antenna or device at various satellites along the geosynchronous satellite arc.

Mounts of the present invention may also be used to aim devices at satellites in non-geosynchronous orbits about the Earth's equator. In such instances, the radius of the arc through which the axis of the device passes corresponds to the ratio of the satellite's orbital radius to the Earth's radius, and the mount is driven by a constant speed motor.

It is thus an object of the present invention to provide a mount which creates a mechanical analog of a satellite arc in order to aim an antenna or other device at satellites along the arc.

It is another object of the present invention to provide a mount for aiming an antenna or other device at satellites in orbit about the Earth's equator and which allows the antenna or device to be quickly, easily and accurately aimed at various such satellites.

It is a further object of the present invention to provide a geosynchronous satellite tracking mount which is structurally simple, inexpensive and easy to install.

It is a further object of the present invention to provide a geosynchronous satellite tracking mount which allows the user to aim an antenna or other device at various satellites according to a scale located on the mount.

It is a further object of the present invention to provide a geosynchronous satellite tracking mount which allows the user to aim an antenna or other devices at various satellites with minimum fine-tuning required when the mount is repositioned toward another satellite.

Other objects, features and advantages of the present invention will become apparent with reference to the remainder of the specification and the drawings hereof.

DETAILED DESCRIPTION OF THE DRAWINGS

Figure 1:
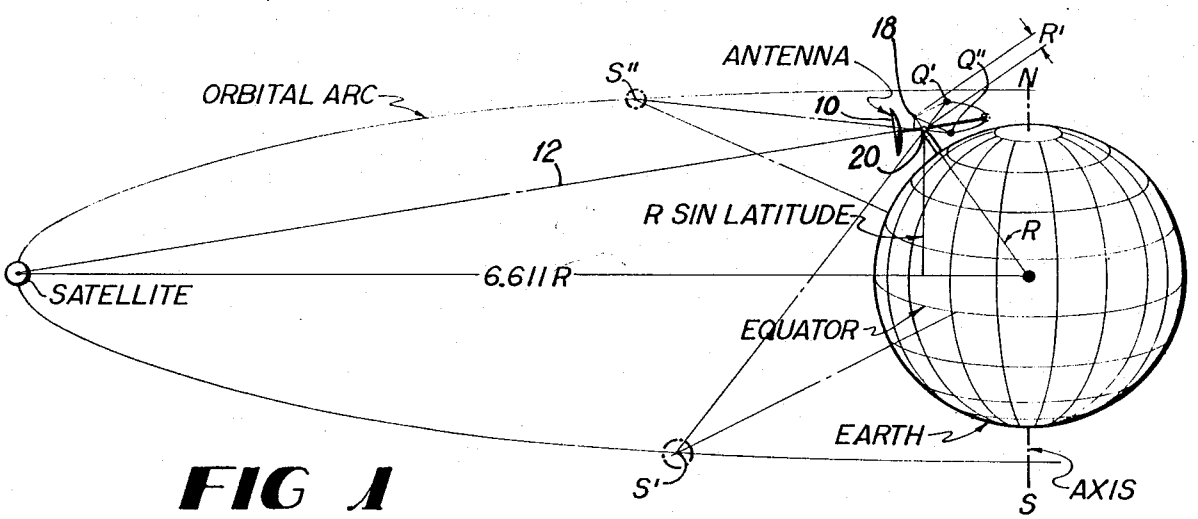
FIG. 1 is a perspective schematic view from space illustrating an arc of geosynchronous satellites and an analogous arc according to the present invention.
Figure 2:
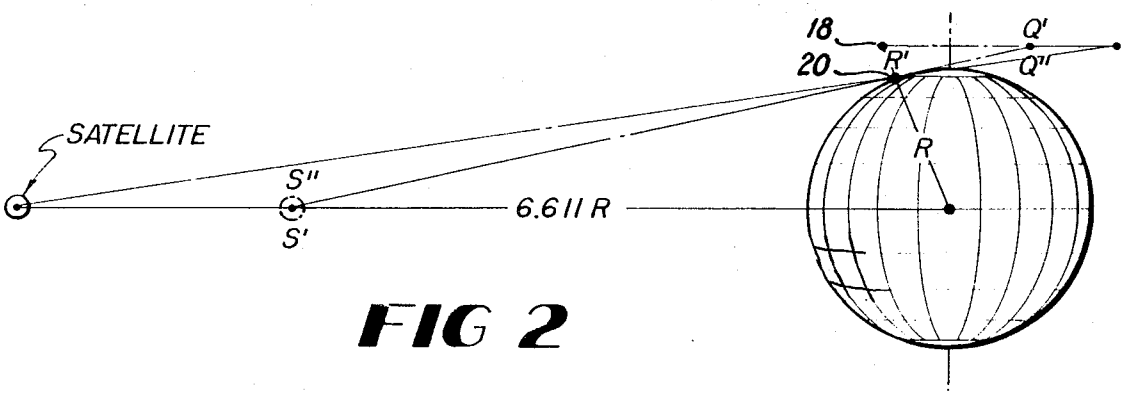
FIG. 2 is a side elevational schematic view of the arc of satellites and the analogous arc illustrated in FIG. 1.
Figures 3, 4:
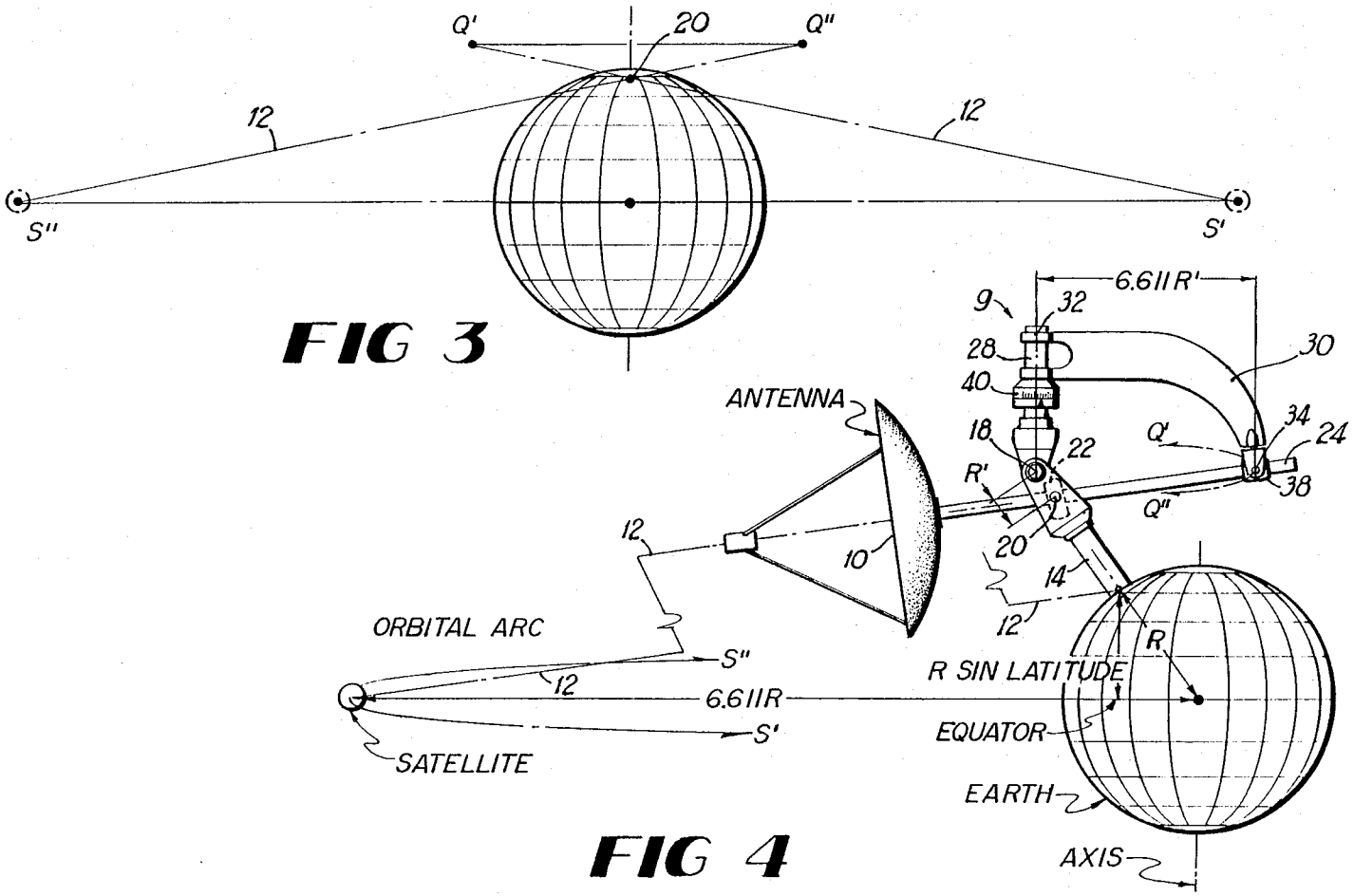
FIG. 3 is a front elevational schematic view of the arc of satellites and the analogous arc illustrated in FIG. 1.
FIG. 4 is a side elevational view of a first embodiment of a mount according to the present invention.

FIGS. 1, 2 and 3 are schematic views from space which illustrate the geometric relationship of an arc of geosynchronous satellites S'-S" with the Earth and with the antenna mounts of the present invention. In order to remain at a point which appears to have constant position above the Earth's surface, such satellites must rotate about the Earth with the same period as the Earth's rotation. This condition is satisfied if such satellites are located at a distance of 6.611 times the radius of the Earth from the Earth's center; there, the centripetal force on the satellite with a period of rotation equal to the Earth's period of rotation balances the Earth's gravity. To avoid apparent change in declination with respect to the Earth, such satellites must be located in the Earth's equatorial plane. The orbit of geosynchronous satellites is therefore described as a circle coplanar to the equatorial plane of the Earth having the Earth's center as its center and having a radius of 6.611 times the Earth's radius.

An antenna or other device located on the Earth's equator could be positioned to track various geosynchronous satellites merely by moving it in a left-right direction, because those satellites are located in the equatorial plane. Most antennas which transmit to or receive from such satellites as well as other devices aimed at such satellites are not located on the equator, however, but at a given latitude above or below the equator. As a result, the antenna or device must look "down" at such satellites. Merely rotating the antenna or device from left to right would cause it to scan through a plane skewed to the Earth's equatorial plane and thus not to track geosynchronous satellites completely accurately. As seen from such a site above or below the equator, the arc of geosynchronous satellites appears to be downwardly concave, and the antenna or device must be positioned in an up and down fashion as well as a left and right fashion to track satellites along that arc.

The present invention takes advantage of the geometric relationship between the position of the antenna or device site, the Earth's center and the orbit of geosynchronous or non-geosynchronous satellites to track such satellites. It incorporates these relationships to force the antenna's or device's axis to rotate through a smaller analogous arc whereby the antenna or device sweeps the larger arc of geosynchronous satellites, as shown, for example, in FIG. 1. As may be seen in that figure, the site is located at a distance R, the radius of the Earth, from the Earth's center. It is offset from the equatorial plane by a distance of R times the sine of the site latitude, and is displaced on the equatorial plane away from the Earth's center a distance of R times the cosine of the latitude. For ease of reference hereinafter, mounts of the present invention will be referred to in connection with aiming antennas; it should be understood, however, that mounts of the present invention may be used to aim any device which one desires to aim at geosynchronous satellites.

According to the theory of the present invention, as illustrated in FIGS. 1-3, an arbitrary reference point 18 is chosen as an analog point to the Earth's center. Another point, the pivot point 20, through which the antenna axis 12 is contrained to pivot, and which is analogous to site location, is chosen at an arbitrary distance R' from the Earth center analog point along a line perpendicular to the Earth's surface, or vertical. A mechanism is constructed to sweep an arc Q'-Q" about the Earth center analog point parallel to the Earth's equatorial plane and having a radius corresponding to the ratio of the satellite's orbital radius to the Earth's radius. In the case of geosynchronous satellites, the ratio is 6.611 times the R′ distance. In the case of non-geosynchronous satellite, it is more for slower-orbiting satellites and less for faster orbiting satellites in the plane of the Earth's equator. The mechanism forces the axis 12 of antenna 10 to rotate about the site location analog point and through arc Q′–Q″ to sweep the arc of geosynchronous satellites S′–S″.

The construction of a mechanical analog as described above to cause an antenna to sweep an arc of geosynchronous satellites or to aim at non-geosynchronous equatorial orbit satellites may be accomplished with various structural configurations, and the following three embodiments are described for purposes of explanation and illustration and not by way of limitation.

Figure 7:
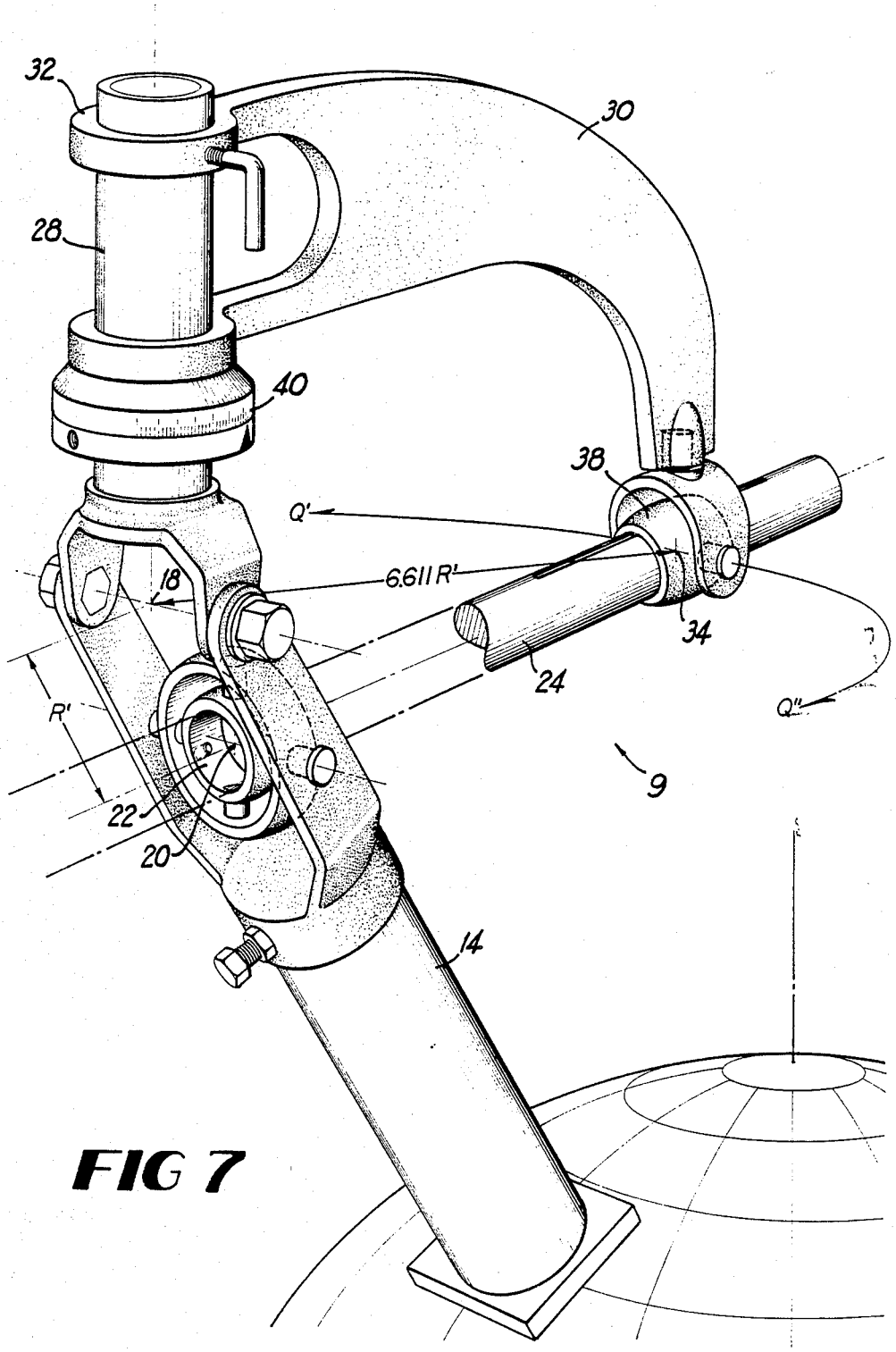
FIG. 7 is a side perspective view of the embodiment illustrated in FIG. 4.
Figure 7A:
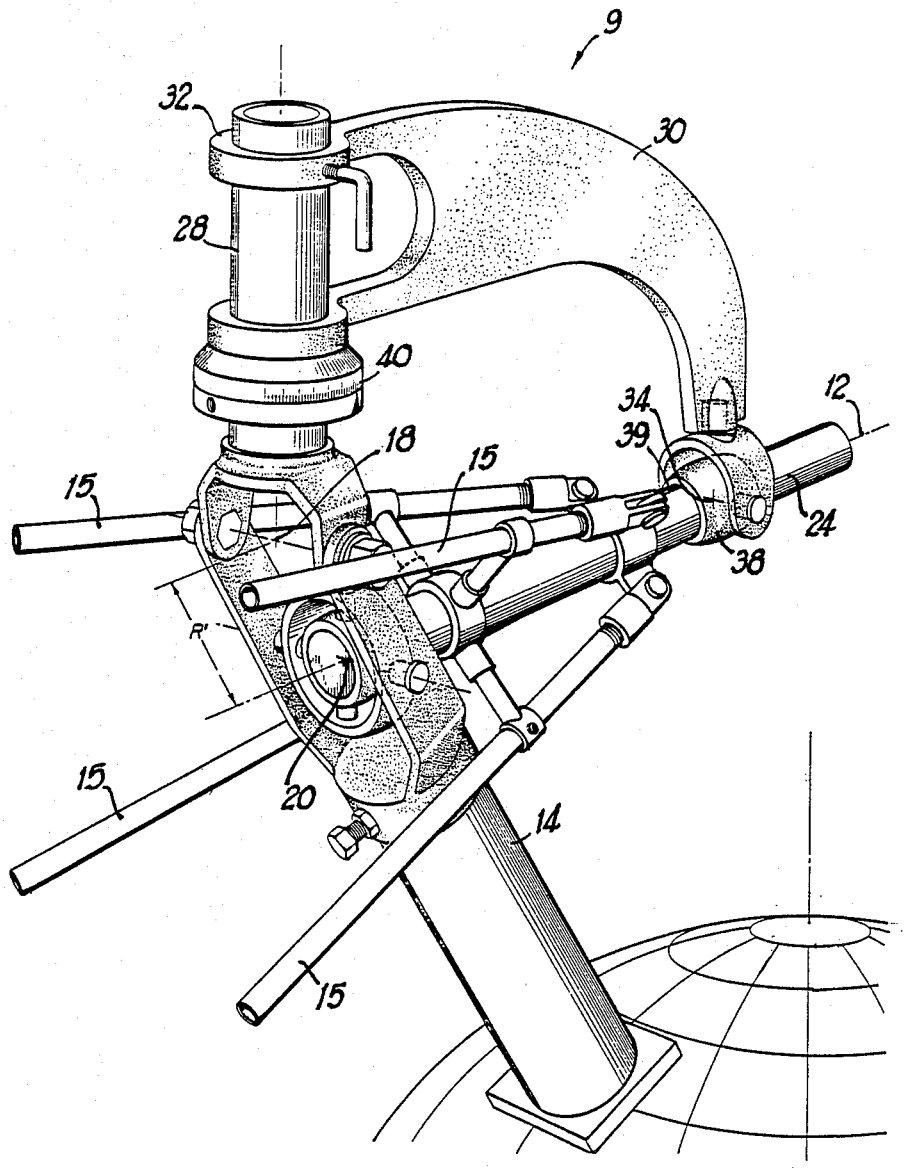
FIG. 7A is a side perspective view of an embodiment corresponding to that shown in FIG. 7 but in which the antenna or device is supported by spars for additional freedom of movement and flexibility.

FIGS. 4, 7 and 7A depict a first embodiment of the antenna mount 9 of the present invention. A base or support means 14 supports the structure of antenna mount 9 and contains Earth center analog or reference point 18. Located on support means 14 a vertical distance R′ from reference point 18 is a site-analog or pivot point 20. Support means 14 as well as the other components of mount 9 may be formed of metal or other suitable rigid material and support means 14 may be generally tubular in shape or otherwise configured to support and interact with other portions of antenna mount 9 as described further below.

Pivot point 20 is the point about which antenna axis 12 will be constrained to rotate. In the preferred embodiment, pivot point 20 is defined by a gimbal means 22 comprising a set of gimbals, a universal-type joint or other pivot means which allows structure supporting antenna 10 to rotate about pivot point 20 with at least two degrees of freedom. Gimbal means 22 may be fixed within an opening in support means 14 to allow such rotation about pivot point 20.

An antenna carrying member 24 to which antenna 10 is mounted is connected to gimbal means 22 whereby axis 12 of antenna 10 passes through pivot point 20. Antenna 10 may also be attached, in this as in other embodiments as shown in FIG. 7A, to spars 15 for additional freedom of motion and flexibility. Antenna carrying member 24 should extend beyond pivot point 20 a distance sufficient to allow it to intersect analog arc Q′–Q″ as described further below. While it is not necessary that antenna carrying member 24 contain each point of antenna axis 12 along its length and thereby be a straight rod, it must be constructed so that axis 12 intersects arc Q′–Q″. In the preferred embodiment antenna carrying member 24 is a straight rod.

A mast means 28 for supporting an arc describing means 30 is pivotally mounted to rotate about reference poit 18 in a plane containing the Earth's axis. More simply stated, mast means 28 is pivotally mounted so that it can be positioned to point substantially at the North Star (Polaris) in the Northern Hemisphere. As a practical matter, antenna mount 9 is oriented in a true north-south direction whereby mast means 28 when pivoted about reference point 18 will pivot along a north-south median. Mast means 28 may be tubular in shape and must pivot about reference point 18 whereby it may be fixed at a selected angle with respect to support means 14. In the preferred embodiment, it is fixed with a bolt, but other appropriate fasteners or means may be utilized. It is fixed to define an angle with respect to horizontal equal to the site latitude of antenna mount 9 in a northerly direction in the northern hemisphere or a southerly direction in the southern hemisphere, in order to be perpendicular or normal to the Earth's equatorial plane (or parallel to its axis).

Rotatably mounted to mast means 28 to rotate in a plane substantially parallel to the Earth's equatorial plane is arc describing means 30. In the preferred embodiment, cuffs 32 constrain arc describing means 30 to rotate about mast means 28 but not slide along it. A set screw or other means allows arc describing means 30 to be set when mount 9 is aimed at a desired satellite; similarly, arc describing means 30 may be positioned remotely by use of a servo mechanism such as a direct drive motor, a linear actuator or other device.

Arc describing means 30 in the preferred embodiment is a generally elongated structural member which supports an arc-constraint point 34 located a distance of 6.611 times the distance from reference point 18 to pivot point 20, in a direction perpendicular to the axis of rotation of arc describing means 30. When arc describing means 30 is rotated about mast means 28, arc constraint point 34 describes arc Q′–Q″ about reference point 18 in a plane substantially parallel to that of the Earth's equatorial plane, at a distance of 6.611 times the distance between the reference point 18 and pivot point 20 for geosynchronous satellites.

Arc describing means 30 is connected to a second gimbal means 38 for receiving a portion of antenna carrying member 24, in order to constrain antenna axis 12 to rotate about pivot point 20 and through arc Q′–Q″. Gimbal means 38 may rotatably receive a portion of antenna carrying member 24; similarly, it may non-rotatably receive antenna carrying member 24 where member 24 is rotatably received by gimbal means 22 as shown in FIG. 7. The latter configuration is particularly useful to eliminate undesired rotation of member 24 when mount 9 is rotated to extreme angles which would otherwise cause the polarization axis of antenna 10 to rotate.

When arc describing means 30 is positioned in a true north-south orientation, antenna 10 would be pointed at a geosynchronous satellite having a longitude corresponding to the longitude of the antenna site. Such an orientation for an antenna mount 9 at 79° west longitude in the vicinity of Buffalo, New York, for instance, may be aimed at Westar 1. The user would swing the arc describing means 30 to his left or to the east to aim antenna 10 at the majority of various other satellites along the arc. On the other hand, a user on the west coast at 135.5° west longitude in the vicinity of San Francisco using antenna mount 9 with arc describing means 30 located in a north-south direction may cause antenna 10 to be aimed at Westar 2 which is located at 135.5° west longitude. He would rotate arc describing means 30 to his right or to the west to aim antenna 10 at the majority of other geosychronous satellites located on the 70°–135° west longitude arc of such satellites.

Cuffs 32 or other portions of arc describing means 30 and mast means 28 may be inscribed with the names of various satellites or degrees of longitude in order to assist the user in aiming antenna 10 at satellites. Preferably, such inscriptions are on a ring rotatable about mast means 28 or arc describing means 30 which may be fixed to correspond to the antenna mount 9's longitude when antenna mount 9 is installed.

FIG. 7 illustrates more clearly such scales 40.

Figure 5:
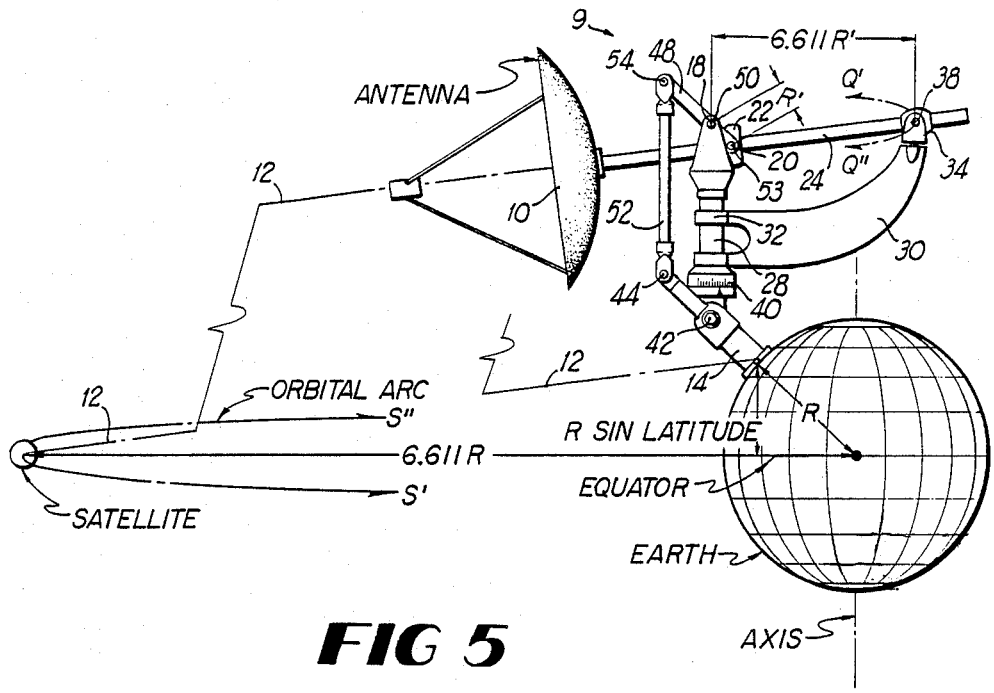
FIG. 5 is a side elevational view of a second embodiment of a mount according to the present invention.
Figure 8:
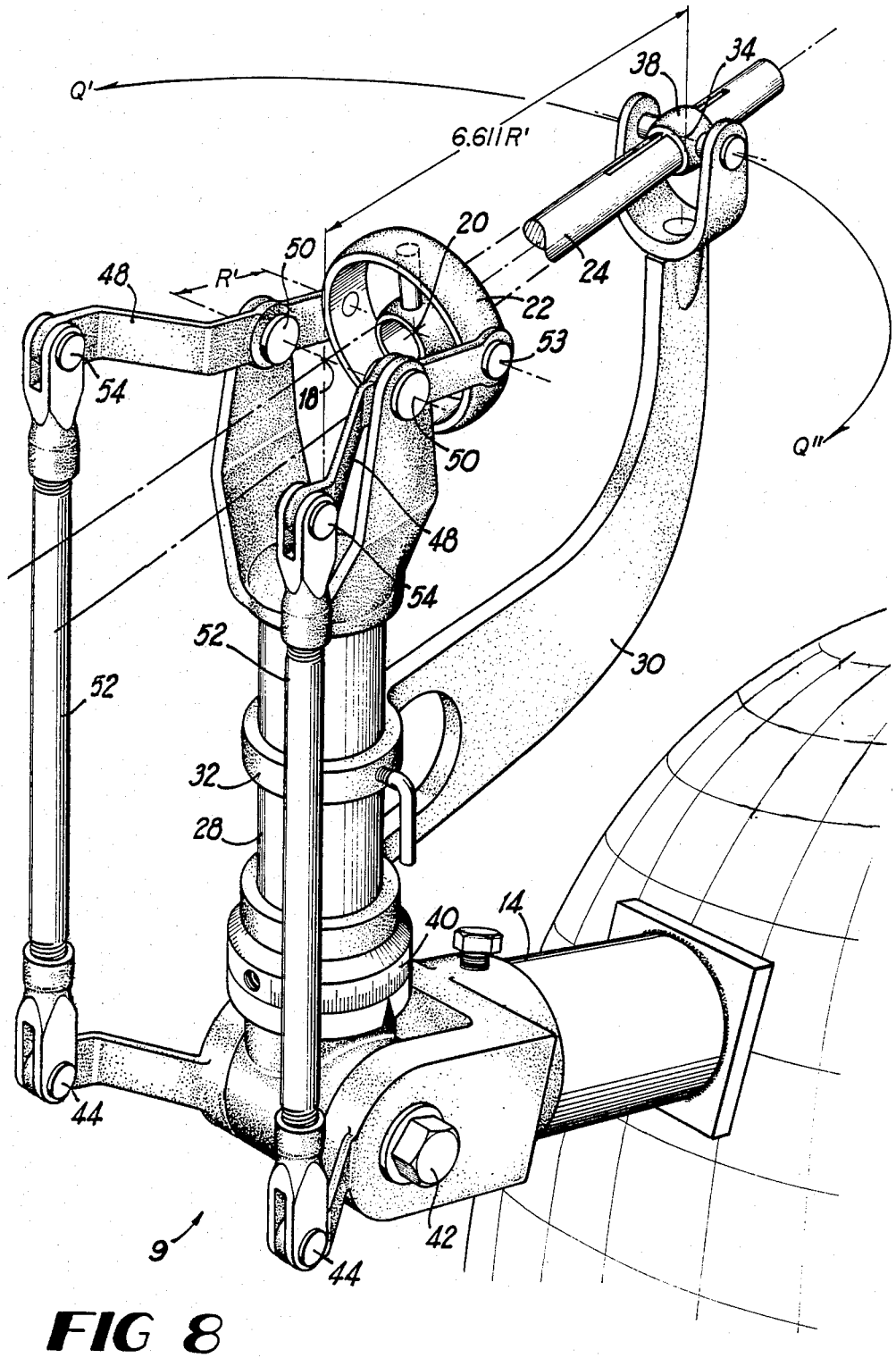
FIG. 8 is a side perspective view of one version of the embodiment illustrated in FIG. 5.
Figure 8A:
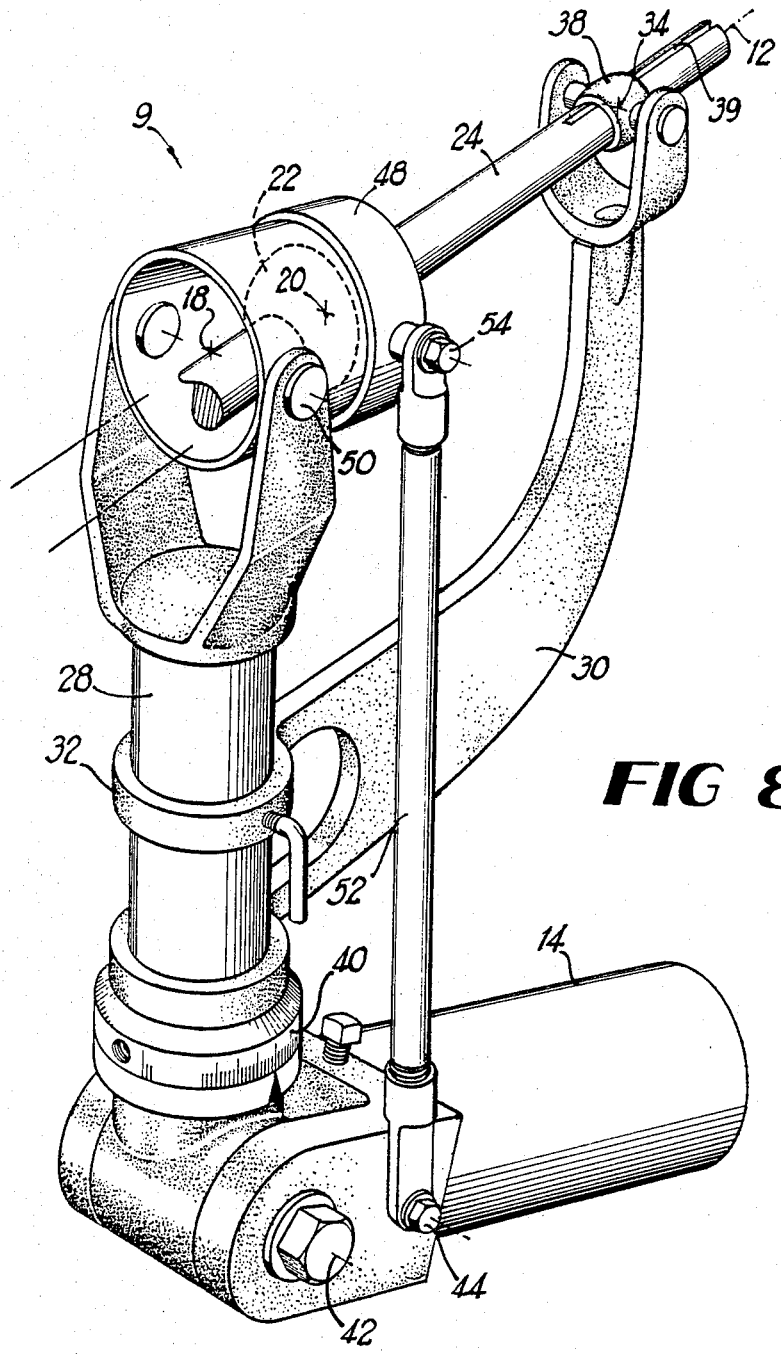
FIG. 8A is a side perspective view of another version of the embodiment illustrated in FIG. 5.

FIGS. 5, 8 and 8A illustrate a second embodiment of the invention. Support means 14 supports the structure of antenna mount 9 and contains a first connection 42 and a second connection 44 located vertically a predetermined distance from the first connection 42. A mast means 28 is pivotally attached to first connection 42 to rotate about first connection 42 in a plane containing the Earth's axis and the site of antenna mount 9. Mast means 28 as in the preferred embodiment may be a tubular shaped member, and it contains Earth center analog or reference point 18.

Arc describing means 30, which may be the same as or similar to arc describing means 30 of the preferred embodiment, rotates about mast means 28 and supports arc constraint point 34. Gimbal means 38 receives carrying member 24 at this point. Arc constraint point 34 defines arc Q'-Q" about reference point 18 and is located a distance of 6.611 times the distance between the reference point 18 and pivot connection 53 on support means 12, in a plane normal to the rotation axis of arc describing means 30 for geosynchronous satellites.

As reference arm 48 is pivotally mounted at third connection 50 to reference point 18 to rotate about that point on mast means 28 in the north-south plane of the antenna mount site. Reference arm 48 is configured to be oriented parallel to the vertical line containing first connection 42 and second connection 44 of support means 12. Reference arm 48 contains a fourth connection 54 located on reference arm 48 from third connection 50 a distance equal to the distance between first connection 42 and second connection 44 on support means 14 and a pivot connection 53. A link 52 connects second connection 44 on support means 14 and fourth connection 54 on reference arm 48, whereby the line containing fourth connection 54 and third connection 50 is parallel to the line containing second connection 44 and first connection 42 on support means 11. Pivot connection 53 is located on reference arm 48 to be oriented from third connection 50 in a direction parallel to the Earth's radius at the mount 9 site.

A pivot means 22 is connected to pivot connection 53 and supports antenna carrying member 24 to rotate with at least two degrees of freedom about pivot point 20. Antenna carrying member 24 is also constrained to intersect arc Q'-Q" by fitting 38 which is pivotally attached to arc constraining point 34 on arc describing means 30.

The mast means 28 is positioned at an angle equal to the latitude from horizontal or the complement of the latitude from vertical toward the north in the northern hemisphere or toward the south in the southern hemisphere and the antenna is positioned by swinging the arc describing means as in the preferred embodiment. Carrying member 24 may be slideably received by either gimbal means 22 or gimbal means 38 as mentioned above in connection with the first embodiment.

Figure 6:
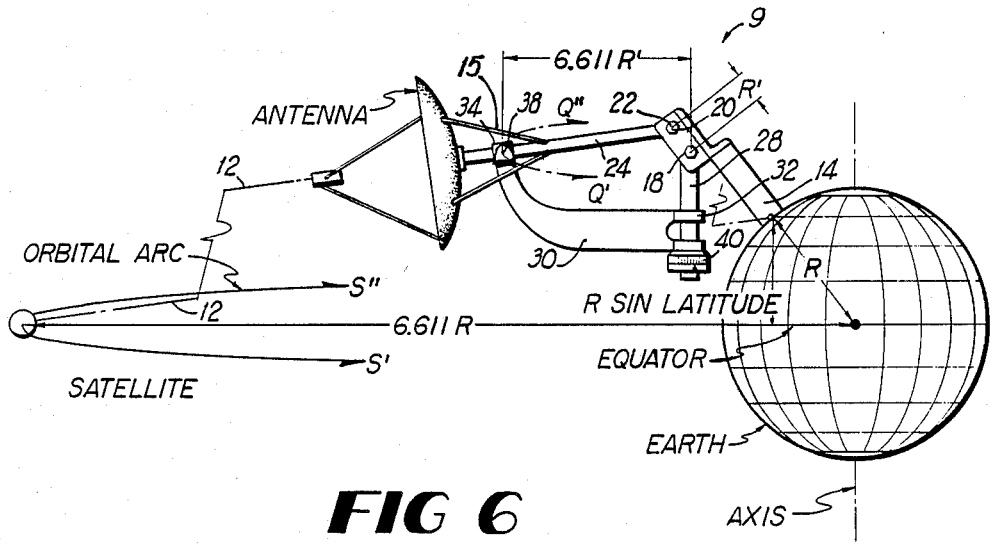
FIG. 6 is a side elevational view of a third embodiment of a mount according to the present invention.
Figure 9:
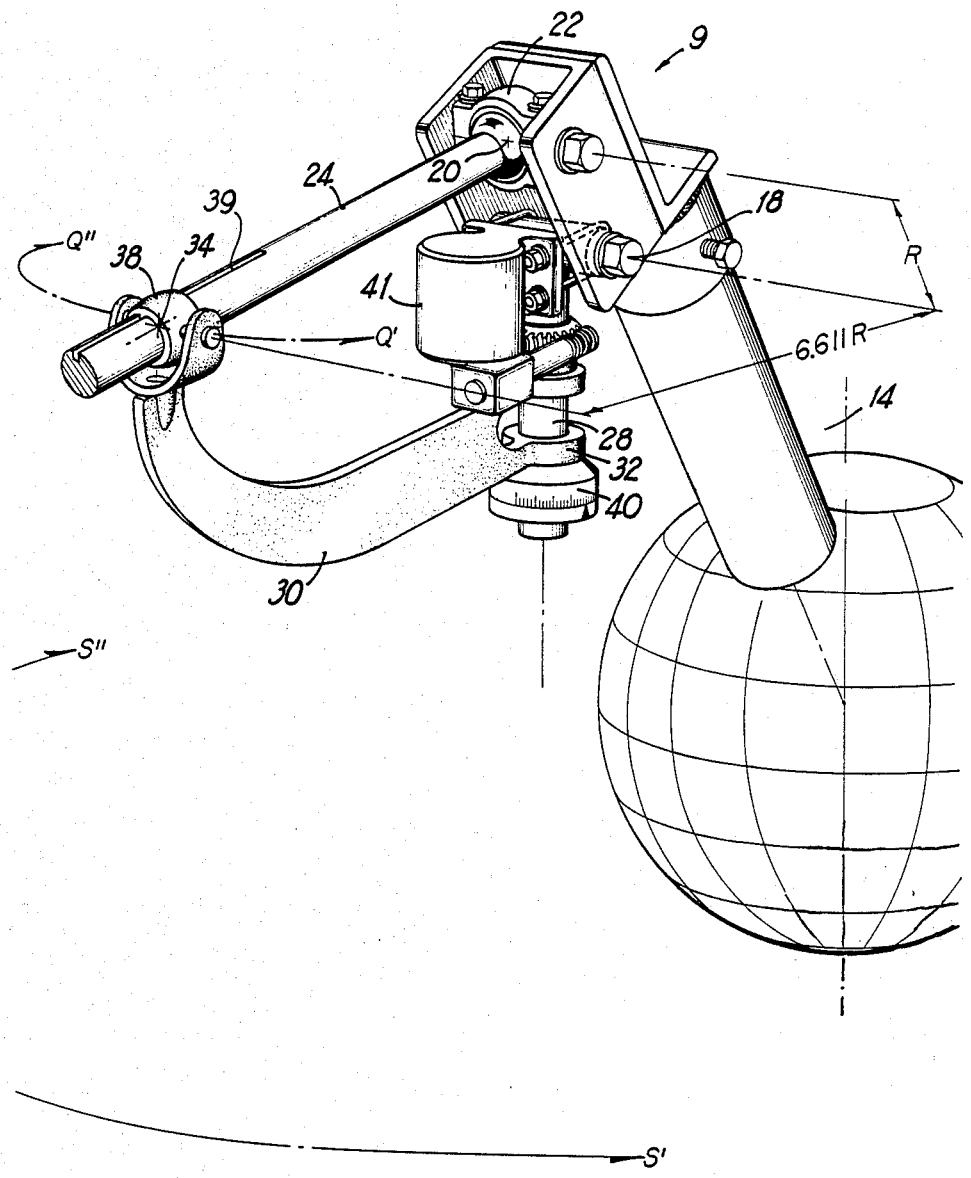
FIG. 9 is a side perspective view of the embodiment illustrated in FIG. 6.

A third embodiment is shown in FIGS. 6 and 9. According to that embodiment, arc describing means 30 and arc Q'-Q" are located toward the arc of satellites with respect to antenna mount 9 instead of away from that arc as in the embodiments of FIGS. 4, 5, 7, 7A, 8 and 8A. A support means 14 supports Earth center analog or reference point 18 and pivot point 20 which is located a predetermined vertical distance R' above reference point 18.

A mast means 28 is pivotally mounted to support means 14 to rotate about reference point 18 in the north-south plane at the antenna mount 9 site. An antenna carrying member 24 is mounted to support means 14 by pivot means 22 to rotate about pivot point 20 with at least two degrees of freedom.

An arc describing means 30 is rotatably but not slideably mounted to mast means 28 and may include scales 40 as in the above-mentioned embodiments. Arc describing means 30 contains an arc constraint point 34 which describes arc Q'-Q" having its center at reference point 18 and a radius of 6.611 times R', the distance between reference point 18 and pivot point 20 on support means 14, and located in a plane parallel to the equatorial plane of the Earth. A gimbal means 38 is pivotally attached to arc defining means 30 to rotate about arc constraint point 34 and capture slideably antenna carrying member 24. A keyway 39 may be utilized, in this as well as other embodiments, to restrain carrying member 24 from rotating and disturbing the polarization of antenna 10.

The antenna 10 is aimed by rotating arc describing means 30 about mast means 28 as described in connection with the above-referenced embodiments. FIG. 9 shows the use of a conventional direct drive mechanism 41 to drive carrying member 24, but a linear actuator as is conventional in the antenna mount art, as well as other types of servo actuators filling precision, power and space requirements, may also be utilized. Such drive mechanisms are equally appropriate for the other embodiments disclosed herein.

As perhaps best illustrated with reference to FIG. 9, mechanism 41 may also be a constant speed motor or actuator to drive carrying member 24 when antenna 10 is aimed a a non-geosynchronous satellite in equatorial orbit.

Figure 10:
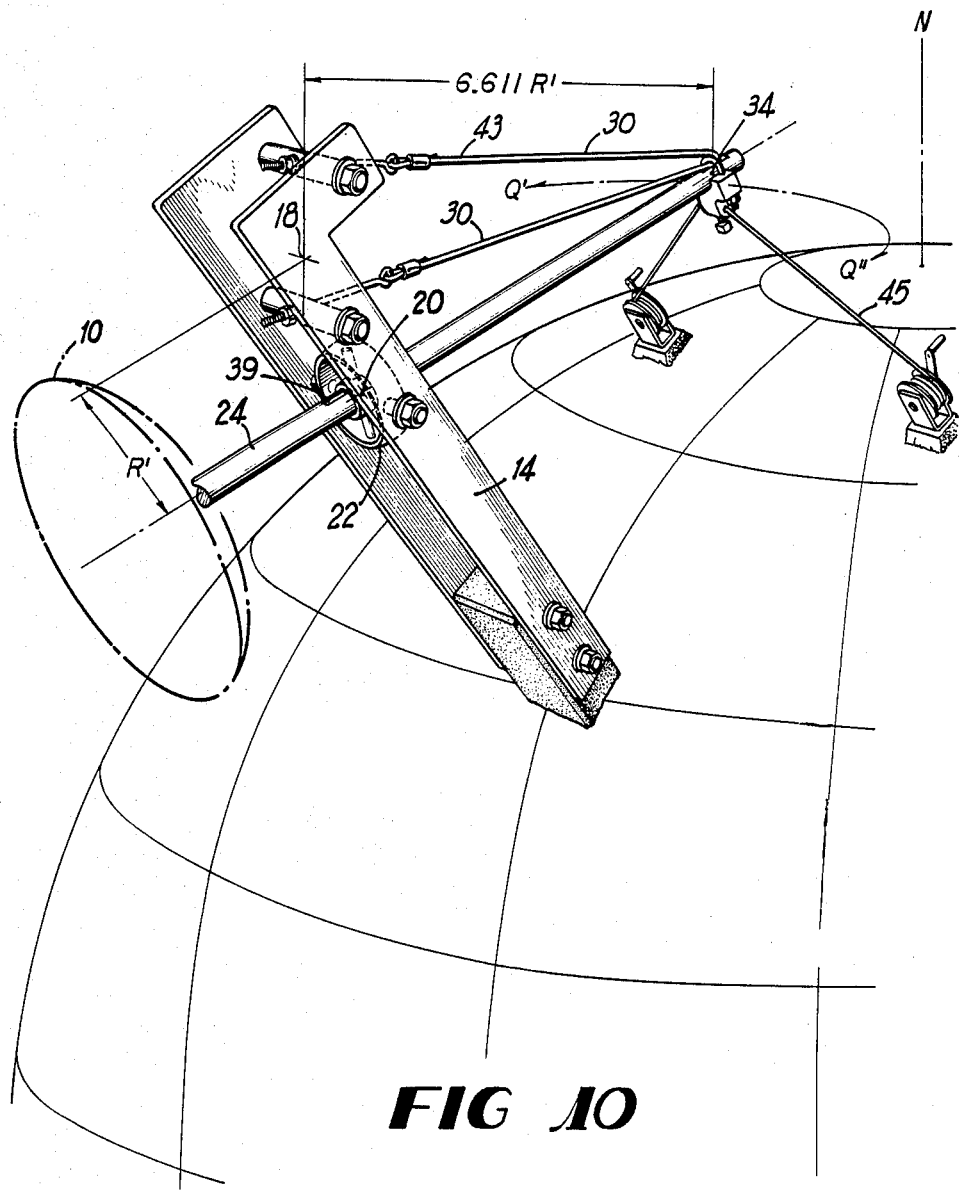
FIG. 10 is a side perspective view of a simple and inexpensive mount according to the present invention.

FIG. 10 illustrates a simpler and less expensive embodiment of mount 9 in which wires or guys 43 act as the arc defining means 30 and backstays 45 are used to cause carrying member 24 to pivot about pivot point 20. Such an embodiment is not as easily adjusted for various latitudes or for various satellites, necessarily compromising flexibility for simplicity. The installer must bear in mind that the line connecting reference point 18 and pivot point 20 is parallel to the radius of the Earth at mount 9's site (or vertical), and that wires 43 must be adjusted so that arc constraint point 34 rotates in an arc about reference point 18 parallel to the Earth $\propto$s equator (or offset from the direction of the line connecting reference point 18 and pivot point 20 by an angle equalling the latitude of mount 9's site), and having a radius of 6.611 times the distance between reference point 18 and pivot point 20, for geosynchronous satellites. Reference point 18 need not be a point located on the structure of mount 9; indeed, as shown in FIG. 10, it can be a "virtual" point about which arc constraint point 34 rotates. Backstays 45 may be controlled by winches or other appropriate means. The structure of mount 9 as shown in FIG. 10 may vary, as may the structures of the other embodiments shown in the other figures, according to considerations of cost, convenience, good design practice and other considerations.

This disclosure is intended to explain and illustrate various embodiments, features, advantages and objects of the invention, and is not intended for purposes of limitation. Various modifications and alternative structural solutions to the invention are contemplated and do not depart from the scope and spirit of the invention.

I claim:

1. A mount for aiming a device at a body in orbit in the plane of the Earth's equator, comprising:

(a) a support means for supporting;

(i) a pivot point; and (ii) a reference point located at a predetermined distance away from the pivot point on a line containing the pivot point and substantially parallel to a line containing the center of the Earth and the pivot point;

(b) a carrying member to which the device is to be attached and which is pivotally connected to the support means so that the device's axis pivots about the pivot point; and (c) an arc defining means rotatably connected to the support means and connected to the carrying member for constraining the axis of the device to pivot about the pivot point and intersect an arc:

(i) having the reference point as its center;

(ii) in a plane substantially parallel to the equatorial plane of the Earth; and (iii) having a radius relative to the distance from the pivot point to the reference point substantially proportional to the ratio of the radius of the body's orbit to the Earth's radius.

2. A mount according to claim 1 further comprising a gimbal means for pivotally and slideably connecting the carrying member to the support means.

3. A mount according to claim 1 further comprising a gimbal means for pivotally and slideably connecting the carrying member to the arc defining means.

4. A mount for a device, comprising:

(a) a support means for supporting:

(i) a pivot point; and (ii) a reference point located a predetermined distance away from the pivot point on a line substantially parallel to a line containing the pivot point and containing the center of the Earth and the pivot point;

(b) a carrying member to which the device is to be attached and which is pivotally connected to the support means so that the device's axis pivots about the pivot point; and (c) an arc defining means rotatably connected to the support means and slideably connected to the carrying member for constraining the carrying member to pivot about the pivot point so that the axis of the device intersects an arc:

(i) whose center is the reference point;

(ii) which lies in a plane substantially parallel to the equatorial plane of the Earth; and (iii) whose radius relative to the predetermined distance between the pivot point and the reference point is substantially proportional to the ratio of the radius of the orbit of geosynchronous satellites about the Earth to the Earth's radius.

5. A mount according to claim 4 wherein the carrying member is slideably connected to the arc defining means.

6. A mount for a device, comprising:

(a) a carrying member to which the device is to be attached; and (b) means for constraining the carrying member to pivot so that the device's axis:

(i) pivots about a pivot point; and (ii) intersects an arc:

(A) whose center point is located a predetermined distance from the pivot point on a line containing the pivot point and substantially parallel to a line containing the pivot point and the center of the Earth;

(B) which lies in a plane substantially parallel to the equatorial plane of the Earth; and (C) whose radius relative to the predetermined distance between the pivot point and the center point is substantially proportional to the ratio of the radius of the orbit of geosynchronous satellites about the Earth to the Earth's radius.

7. An antenna mount, comprising:

(a) a support means for supporting:

(i) a pivot point; and (ii) a reference point located substantially vertically a predetermined distance from the pivot point;

(b) a mast means connected to the reference point of the support means to pivot about the reference point in a plane substantially parallel to the plane containing the Earth's axis and the reference point;

(c) an antenna carrying member which is pivotally connected to the support means to pivot about the pivot point and to which the antenna is to be attached;

(d) an arc defining means for controlling pivoting of the antenna carrying member about the pivot point, which arc defining means is rotatably connected to the mast means to rotate about and in a plane normal to the axis of the mast means; and (e) a gimbal means for receiving a portion of the antenna carrying member which gimbal means is connected to the arc defining means a distance from the reference point on a line substantially perpendicular to the axis of the mast means substantially 6.611 times the distance between the pivot point and the reference point.

8. An antenna mount, comprising:

(a) a support means having a first connection and a second connection located a predetermined distance and direction away from the first connection;

(b) a mast connected to the first connection to pivot about a substantially horizontal axis and having a reference point and an axis containing the first connection and the reference point, which mast is positionable such that its axis is substantially parallel to the Earth's axis;

(c) a reference arm connected to the reference point of the mast at a third connection to rotate about the mast in substantially the same plane as that in which the mast rotates about the support means and having:

(i) a fourth connection located substantially the same distance and direction from the third connection as the distance and direction between the first and second connections on the mast; and (ii) a pivot connection;

(d) a link means connected to the second connection of the support means and the fourth connection of the reference arm, the distance between such connections being substantially the same as the distance from the first connection on the support means and the reference point on the mast, for causing the line connecting the reference point and the pivot connection to be substantially parallel to the radius of the Earth at the mount;

(e) an antenna carrying member to which the antenna is to be attached which is pivotally connected to the pivot connection of the reference arm;

(f) an arc defining means connected to the mast means to rotate about the axis containing the first connection and the reference point; and (g) a gimbal means connected to the arc defining means and which, when the arc defining means rotates, defines a constraining arc located a distance substantially 6.611 times the distance from the third connection to the pivot connection of the reference arm, in a plane containing the reference point and oriented substantially perpendicular to the first connection-reference point axis, for receiving a portion of the antenna carrying member and causing the axis of the device to pass through the constraining arc.

9. An antenna mount, comprising:

(a) a support means having a pivot point and a reference point located substantially vertically a predetermined distance from the pivot point;

(b) a mast means connected to the reference point to rotate about a substantially horizontal axis, which mast means is positionable so that its axis is substantially parallel to the Earth's axis;

(c) an antenna carrying member to which the antenna is to be attached and which is pivotally connected to the pivot point of the support means;

(d) an arc defining means connected to the mast means to rotate about the axis of the mast means; and (e) a gimbal means connected to the arc defining means and which, when the arc defining means rotates, defines a constraining arc located a distance substantially 6.611 times the distance between the pivot and the reference point of the support means, in a plane containing the reference point and oriented substantially perpendicular to the mast means axis, for receiving a portion of the antenna carrying member and causing the axis of the device to pass through the constraining arc.

10. A mount according to any of claims 1, 2, 3, 4, 7, 8 or 9 wherein the support means and the arc defining means are calibrated with means to assist in aiming the device at predetermined geosynchronous satellites.

11. A mount according to any of claims 4, 7, 8 or 9 wherein the carrying member is slideably connected to the support means.

12. A mount according to any of claims 7, 8 or 9 wherein the carrying member is slideably connected to the gimbal means.

13. A method for aiming a device at satellites located on an arc in the plane of the Earth's equator, comprising the steps of:

(a) providing a carrying member on which the device is to be mounted;

(b) constraining the carrying member so that the device's axis pivots with at least two degrees of freedom about a site-analog point; and (c) constraining the carrying member to pivot so that the device's axis intersects a satellite arc analog arc:

(i) whose center point is an Earth center analog point located vertically a predetermined distance from the site-analog point;

(ii) which lies in a plane substantially parallel to the Earth's equatorial plane; and (iii) which has a radius relative to the predetermined distance between the site-analog point and the Earth center analog point proportional to the ratio of the radius of the satellite arc to the Earth's radius.

* * * * *